US009048081B2

(12) United States Patent
Green et al.

(10) Patent No.: US 9,048,081 B2
(45) Date of Patent: Jun. 2, 2015

(54) FAST PUSHING TIME OF FLIGHT MASS SPECTROMETER COMBINED WITH RESTRICTED MASS TO CHARGE RATIO RANGE DELIVERY

(75) Inventors: Martin Raymond Green, Bowdon (GB); Daniel James Kenny, Knutsford (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 13/997,556

(22) PCT Filed: Dec. 22, 2011

(86) PCT No.: PCT/GB2011/052577

§ 371 (c)(1),
(2), (4) Date: Sep. 6, 2013

(87) PCT Pub. No.: WO2012/085595

PCT Pub. Date: Jun. 28, 2012

(65) Prior Publication Data

US 2013/0334413 A1 Dec. 19, 2013

Related U.S. Application Data

(60) Provisional application No. 61/432,810, filed on Jan. 14, 2011.

(30) Foreign Application Priority Data

Dec. 24, 2010 (GB) ..... 1021944.2

(51) Int. Cl.
*H01J 49/40* (2006.01)
*H01J 49/02* (2006.01)
*H01J 49/00* (2006.01)

(52) U.S. Cl.
CPC ..... *H01J 49/401* (2013.01); *H01J 49/0031* (2013.01)

(58) Field of Classification Search
CPC . H01J 49/0027; H01J 49/004; H01J 49/0061; H01J 49/40; H01J 49/401; H01J 49/403; H01J 49/405; H01J 49/406; H01J 49/408
USPC ..... 250/281, 282, 286, 287
See application file for complete search history.

(56) References Cited

U.S. PATENT DOCUMENTS 5,396,065 A 3/1995 Myerholtz et al.
6,365,893 B1 * 4/2002 Le Cocq ..... 250/287
6,861,645 B2 * 3/2005 Franzen ..... 250/282

(Continued)

*Primary Examiner* — Michael Logie
*Assistant Examiner* — David E Smith
(74) *Attorney, Agent, or Firm* — Diederiks & Whitelaw, PLC

(57) ABSTRACT

Ions having a restricted range of mass to charge ratios are transmitted to the acceleration region of a Time of Flight mass analyzer. A control system applies a first extraction pulse to an acceleration electrode in order to accelerate a first group of ions into the time of flight region at a first time T1, wherein ions having the lowest mass to charge ratio in the first group of ions have a time of flight $\Delta T1_{min}$ through the time of flight region and ions having the highest mass to charge ratio in the first group of ions have a time of flight $\Delta T1_{max}$ through the time of flight region. The control system applies a second extraction pulse to the acceleration electrode at a subsequent second time T2, wherein $\Delta T1_{max}-\Delta T1_{min} \leq T2-T1 < \Delta T1_{max}$.

15 Claims, 4 Drawing Sheets

(56) References Cited

U.S. PATENT DOCUMENTS

| | | | | |
|---|---|---|---|---|
| 6,900,431 | B2 * | 5/2005 | Belov et al. | 250/282 |
| 8,183,524 | B2 | 5/2012 | Kenny et al. | |
| 8,410,430 | B2 | 4/2013 | Kenny et al. | |
| 2005/0133712 | A1 * | 6/2005 | Belov et al. | 250/287 |
| 2009/0266983 | A1 * | 10/2009 | Yamamoto et al. | 250/287 |
| 2010/0096543 | A1 * | 4/2010 | Kenny et al. | 250/282 |

* cited by examiner

FAST PUSHING TIME OF FLIGHT MASS SPECTROMETER COMBINED WITH RESTRICTED MASS TO CHARGE RATIO RANGE DELIVERY

CROSS-REFERENCE TO RELATED APPLICATION

This application represents a National Stage application of PCT/GB2011/052577 entitled "Fast Pushing Time of Flight Mass Spectrometer Combined With Restricted Mass to Charge Ratio Range Delivery" filed 22 Dec. 2011 which claims priority from and the benefit of U.S. Provisional Patent Application Ser. No. 61/432,810 filed on 14 Jan. 2011 and United Kingdom Patent Application No. 1021944.2 filed on 24 Dec. 2010. The entire contents of these applications are incorporated herein by reference.

BACKGROUND TO THE PRESENT INVENTION

The present invention relates to a mass spectrometer and a method of mass spectrometry.

Orthogonal acceleration Time of Flight mass spectrometry has proved to be an invaluable tool in many applications. Historically, the benefits of orthogonal acceleration Time of Flight mass spectrometry include high resolution, good mass measurement accuracy and excellent full mass range sensitivity.

In most known orthogonal acceleration Time of Flight mass analysers the period between extraction pulses is arranged to be greater than or equal to the time of flight of ions having the maximum mass to charge ratio within the mass spectrum. So, for example, if a first extraction pulse is produced at a time T1, wherein ions having the lowest mass to charge ratio have a time of flight $\Delta T1_{min}$ through the time of flight region and ions having the highest mass to charge ratio have a time of flight $\Delta T1_{max}$ through the time of flight region and wherein a second extraction pulse is applied to the acceleration electrode at a subsequent second time T2, then $T2-T1 \geq \Delta T1_{max}$.

The fast experimental times associated with conventional orthogonal acceleration Time of Flight mass spectrometers make orthogonal acceleration Time of Flight mass spectrometer an ideal choice for tandem instruments such as ion mobility-Time of Flight mass analysers (IMS-ToF) and ion trap-Time of Flight mass analysers (IT-ToF). According to such arrangements the separation afforded by the IMS device or the ion trap can be profiled by the orthogonal acceleration Time of Flight analysers without significant sensitivity losses.

WO2008/087389 discloses a Time of Flight mass analyser wherein the time period between successive orthogonal acceleration pulses is less than the time of flight of ions having the maximum mass to charge ratio of interest. Some ions are subject to wrap-around and will appear in a subsequent mass spectrum. Mass spectra are obtained at two different sampling rates and are compared. Mass peaks relating to ions which have been subject to wrap-around are identified. So, for example, if a first extraction pulse is produced at a time T1, wherein ions having the lowest mass to charge ratio have a time of flight $\Delta T1_{min}$ through the time of flight region and ions having the highest mass to charge ratio have a time of flight $\Delta T1_{max}$ through the time of flight region and wherein a second extraction pulse is applied to the acceleration electrode at a subsequent second time T2, then $\Delta T1_{max}-\Delta T1_{min} > T2-T1 < \Delta T1_{max}$. As a result, some mass spectral data relating to two subsequent orthogonal acceleration pulses will overlap. Mass spectral data which is subject to wrap around is then identified and corrected.

It is desired to provide an improved Time of Flight mass analyser and method of mass analysis.

SUMMARY OF THE PRESENT INVENTION

According to an aspect of the present invention there is provided a mass spectrometer comprising:

a Time of Flight mass analyser comprising an acceleration electrode, a time of flight region and an ion detector; and a control system arranged and adapted to apply a first extraction pulse to the acceleration electrode in order to accelerate a first group of ions into the time of flight region at a first time T1, wherein ions having the lowest mass to charge ratio in the first group of ions have a time of flight $\Delta T1_{min}$ through the time of flight region and ions having the highest mass to charge ratio in the first group of ions have a time of flight $\Delta T1_{max}$ through the time of flight region;

wherein:

the control system is arranged and adapted to apply a second extraction pulse to the acceleration electrode at a subsequent second time T2, wherein $\Delta T1_{max}-\Delta T1_{min} \leq T2-T1 < \Delta T1_{max}$.

The present invention has a number of advantages over the approach disclosed in WO2008/087389. According to the approach disclosed in WO2008/087389 two mass spectral data sets having different time intervals between successive orthogonal acceleration pulses need to be obtained. Having obtained two data sets using different time periods between successive orthogonal acceleration pulses the mass spectral data then needs to be analysed in order to identify peaks which are subject to wrap-around. The mass spectral data then needs to be separated into data which has not been subject to wrap-around and data which has been subject to wrap-around. The data which has been subject to wrap-around needs to be corrected and then combined with the data which has not been subject to wrap around.

The present invention avoids the requirement to obtain two data sets using two different time intervals between successive orthogonal acceleration pulses and the need to use fairly extensive post-processing to identify and correct data which has been subject to wrap around.

An important distinction between the present invention and the approach disclosed in WO2008/087389 is that according to the present invention $\Delta T1_{max}-\Delta T1_{min} \leq T2-T1$. As a result, data is not subject to wrap around and does not need to be post-processed.

An important feature of the present invention is that a high duty cycle is obtained and that mass spectral data is obtained directly without needing to use complex convolution/deconvolution techniques or complex post-processing.

The present invention is, therefore, particularly advantageous compared to known Time of Flight mass analysers and the approach disclosed in WO2008/087389.

According to the preferred embodiment the second extraction pulse applied to the acceleration electrode causes a second group of ions to be accelerated into the time of flight region at time T2. Ions having the lowest mass to charge ratio in the second group of ions have a time of flight $\Delta T2_{min}$ through the time of flight region and ions having the highest mass to charge ratio in the second group of ions have a time of flight $\Delta T2_{max}$ through the time of flight region. The control system is preferably arranged and adapted to apply a third extraction pulse to the acceleration electrode at a subsequent second time T3, wherein $\Delta T2_{max}-\Delta T2_{min} \leq T3-T2 < \Delta T2_{max}$.

According to the preferred embodiment the control system is preferably arranged and adapted to apply the third extraction pulse to the acceleration electrode in order to accelerate a third group of ions into the time of flight region at the third time T3, wherein ions having the lowest mass to charge ratio in the third group of ions have a time of flight $\Delta T3_{min}$ through the time of flight region and ions having the highest mass to charge ratio in the third group of ions have a time of flight $\Delta T3_{max}$ through the time of flight region, wherein the control system is arranged and adapted to apply a fourth extraction pulse to the acceleration electrode at a subsequent fourth time T4, wherein $\Delta T3_{max}-\Delta T3_{min} \leq T4-T3 < \Delta T3_{max}$.

The Time of Flight mass analyser preferably comprises an orthogonal acceleration Time of Flight mass analyser.

The Time of Flight mass analyser preferably further comprises an acceleration region adjacent the acceleration electrode, wherein the mass spectrometer further comprises a restriction device arranged upstream of the acceleration region. The restriction device is preferably arranged and adapted to restrict the mass to charge ratio range of ions which are present in the acceleration region when an extraction pulse is applied to the acceleration electrode so that the mass to charge ratio range of ions which are subsequently accelerated into the time of flight region is restricted.

The restriction device is preferably selected from the group consisting of: (i) a further mass spectrometer or mass analyser; (ii) an ion trap; (iii) a Time of Flight mass analyser; (iv) an ion trap having one or more pseudo-potential barriers wherein ions are scanned out of the ion trap via the one or more pseudo-potential barriers; (v) a mass filter; (vi) a quadrupole mass filter; (vii) a magnetic sector mass filter; and (viii) an ion mobility separator.

The control system is preferably arranged and adapted to determine the mass to charge ratio or time of flight of ions detected by the ion detector based upon knowledge of the restricted mass to charge ratio range of ions which are pulsed into the time of flight region and/or the characteristics of the Time of Flight mass analyser.

The control system preferably determines the mass to charge ratio or time of flight of ions in real time on an extraction pulse to extraction pulse basis.

The control system preferably determines the mass to charge ratio or time of flight of ions by post processing summed or combined data or mass spectral data.

The restricted mass to charge ratio range of ions entering the Time of Flight mass analyser and arriving at the acceleration region preferably varies over a second timescale and wherein the period between extraction pulses is set based upon the predicted variation in the mass to charge ratio range of ions arriving at the acceleration region over the second timescale.

The mass to charge ratio range may be varied by a device selected from the group consisting of: (i) a further mass spectrometer or mass analyser; (ii) an ion trap; (iii) a Time of Flight mass analyser; (iv) an ion trap having one or more pseudo-potential barriers wherein ions are scanned out of the ion trap via the one or more pseudo-potential barriers; (v) a mass filter; (vi) a quadrupole mass filter; (vii) a magnetic sector mass filter; and (viii) an ion mobility separator.

According to another aspect of the present invention there is provided a method of mass spectrometry comprising:

providing a Time of Flight mass analyser comprising an acceleration electrode, a time of flight region and an ion detector; and applying a first extraction pulse to the acceleration electrode in order to accelerate a first group of ions into the time of flight region at a first time T1, wherein ions having the lowest mass to charge ratio in the first group of ions have a time of flight $\Delta T1_{min}$ through the time of flight region and ions having the highest mass to charge ratio in the first group of ions have a time of flight $\Delta T1_{max}$ through the time of flight region;

wherein the method further comprises:

applying a second extraction pulse to the acceleration electrode at a subsequent second time T2, wherein $\Delta T1_{max}-\Delta T1_{min} \leq T2-T1 < \Delta T1_{max}$.

According to another aspect of the present invention there is provided a mass spectrometer comprising:

a Time of Flight mass analyser comprising an acceleration electrode, a time of flight region and an ion detector; and a control system arranged and adapted to apply a first extraction pulse to the acceleration electrode in order to accelerate a first group of ions into the time of flight region at a first time T1, wherein ions having the lowest mass to charge ratio in the first group of ions have a time of flight $\Delta T1_{min}$ through the time of flight region and ions having the highest mass to charge ratio in the first group of ions have a time of flight $\Delta T1_{max}$ through the time of flight region;

wherein:

the control system is arranged and adapted to apply a second extraction pulse to the acceleration electrode at a subsequent second time T2, wherein $T2-T1 < \Delta T1_{max}$ and wherein the intensity of ions as a function of mass to charge ratio is determined directly by the ion detector without requiring spectral deconvolution or the comparison of two mass spectral data sets.

According to another aspect of the present invention there is provided a method of mass spectrometry comprising:

providing a Time of Flight mass analyser comprising an acceleration electrode, a time of flight region and an ion detector; and applying a first extraction pulse to the acceleration electrode in order to accelerate a first group of ions into the time of flight region at a first time T1, wherein ions having the lowest mass to charge ratio in the first group of ions have a time of flight $\Delta T1_{min}$ through the time of flight region and ions having the highest mass to charge ratio in the first group of ions have a time of flight $\Delta T1_{max}$ through the time of flight region;

wherein the method further comprises:

applying a second extraction pulse to the acceleration electrode at a subsequent second time T2, wherein $T2-T1 < \Delta T1_{max}$ and wherein the intensity of ions as a function of mass to charge ratio is determined directly by the ion detector without requiring spectral deconvolution or the comparison of two mass spectral data sets.

The preferred embodiment relates to an apparatus for and a method of significantly increasing the sampling duty cycle of a Time of Flight mass spectrometer and in particular an orthogonal acceleration Time of Flight mass spectrometer.

According to the preferred embodiment the upper and lower mass to charge ratios and thus mass to charge ratio range of ions arriving at an acceleration region adjacent an acceleration electrode of a Time of Flight mass analyser is restricted, enabling the number of orthogonal acceleration Time of Flight experiments per second to be increased whilst still maintaining the ability to make direct measurements of the time of flights of ions of interest.

Prior knowledge of the mass to charge ratio range together with the knowledge of the time of flight to mass to charge ratio conversion factor of the orthogonal acceleration Time of Flight mass analyser allows the pusher period to be set to a minimum value whilst preventing the lower mass to charge ratio ions from push number (N+1) and the higher mass to charge ratio ions from push number (N−1) from arriving at the ion detector at the same time as ions having mass to charge ratios of interest from push number (N).

In a preferred embodiment the mass to charge ratio range is deterministically restricted by synchronising the orthogonal accelerator or orthogonal acceleration region of a Time of Flight mass analyser with packets of ions released from, for example, a travelling wave device. The travelling wave device may, for example, comprise an ion guide comprising a plurality of electrodes wherein one or more transient DC voltages or one or more transient DC voltage waveforms are applied to the electrodes. The travelling wave device is preferably used to partition a continuous stream of ions into a series of packets of ions. If ions are released as a series of packets, rather than allowed to flow continuously, then the application or pulsing of an extraction field in the Time of Flight mass analyser can be synchronised with respect to the release of each packet of ions from the travelling wave device.

Ions with constant energy and different mass to charge ratios will travel with different velocities. Hence, ions with different mass to charge ratios will arrive at the pusher electrode or orthogonal acceleration region at slightly different times. The time delay after the release of ions to the application of the pusher voltage determines the mass to charge ratios of ions which are transmitted into the orthogonal acceleration Time of Flight mass analyser. For these ions the duty cycle can now be increased to substantially 100%. However, ions with different mass to charge ratios will not lie fully in the orthogonal acceleration region at the time that the pusher voltage is applied to the orthogonal acceleration electrode and hence the Time of Flight mass analyser will have lower sampling efficiencies.

The mass spectrometer preferably further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") on source; (ix) a Chemical Ionisation ("CI") on source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source.

The mass spectrometer preferably further comprises one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer may further comprise a stacked ring ion guide comprising a plurality of electrodes having an aperture through which ions are transmitted in use and wherein the spacing of the electrodes increases along the length of the ion path. The apertures in the electrodes in an upstream section of the ion guide may have a first diameter and the apertures in the electrodes in a downstream section of the ion guide may have a second diameter which is smaller than the first diameter. Opposite phases of an AC or RF voltage are preferably applied to successive electrodes.

BRIEF DESCRIPTION OF THE DRAWINGS

Various embodiments of the present invention together with other arrangements given for illustrative purposes only will now be described, by way of example only, and with reference to the accompanying drawings in which.

DETAILED DESCRIPTION OF THE PREFERRED EMBODIMENTS

Figure 1A:
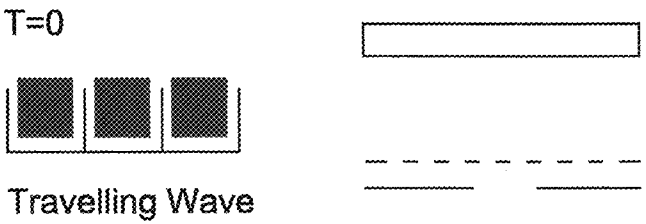
FIG. 1A shows a travelling wave device arranged upstream of a Time of Flight mass analyser.
Figure 1B:
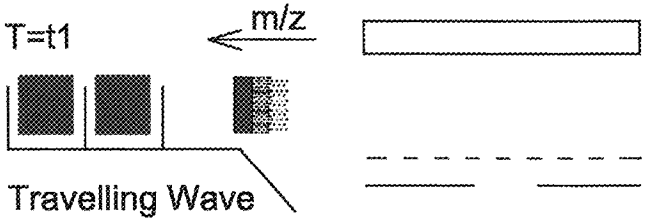
FIG. 1B shows how the release of a packet of ions from a travelling wave device can result in mass to charge ratio separation of the ions as they travel towards the acceleration region of the Time of Flight mass analyser.
Figure 1C:
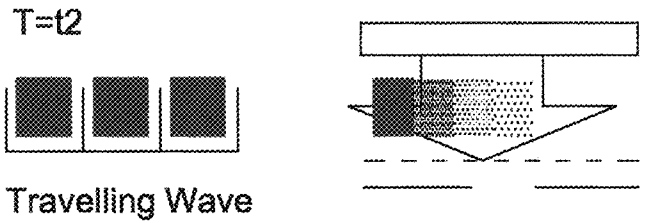
FIG. 1C shows how the application of an extraction pulse may be synchronised with the arrival of ions having desired mass to charge ratios at an acceleration region adjacent an acceleration electrode and FIG. 1D shows how a restricted mass to charge ratio range of ions may be transmitted or pulsed into the drift region of the Time of Flight mass analyser.
Figure 1D:
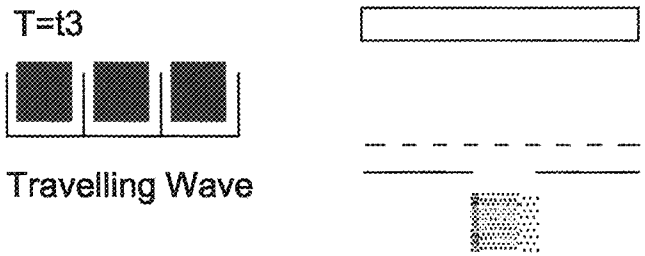
Figure 2A:
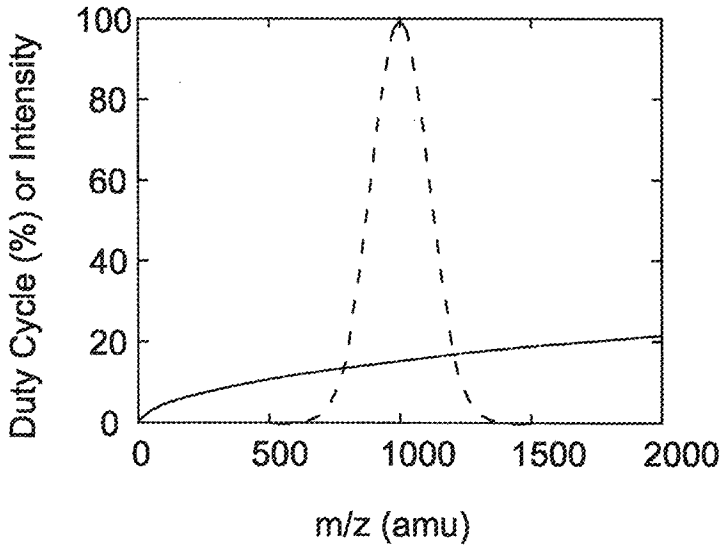
FIG. 2A shows a standard duty cycle (solid curve) and an enhanced duty cycle (dashed curve) obtained by restricting the mass to charge ratio of ions transmitted to the Time of Flight mass analyser and FIG. 2B shows a time of flight dependent duty cycle and illustrates time of flight regions which are not utilised conventionally.

A preferred embodiment of the present invention will now be described. According to the preferred embodiment the duty cycle of a Time of Flight mass analyser is preferably enhanced by restricting the mass to charge ratio of ions transmitted to the Time of Flight mass analyser at any instance in time. The sensitivity of the Time of Flight mass analyser is preferably improved over a reduced mass range in a manner similar to that illustrated in FIG. 2A.

Figure 2B:
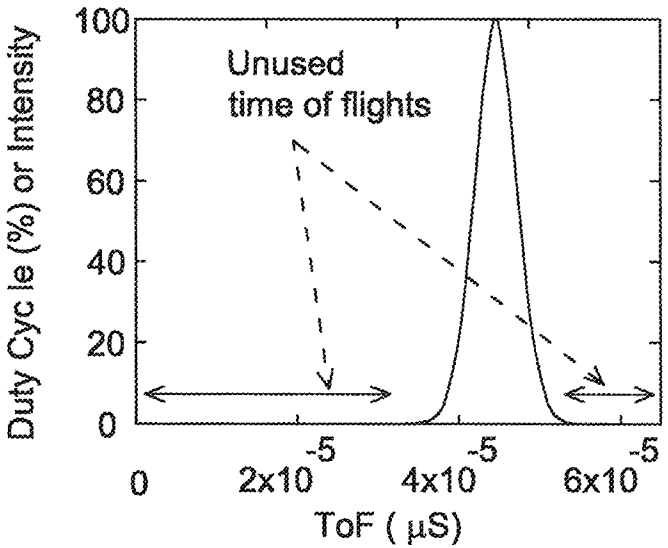

FIG. 2B shows the effect of converting the x-axis of the enhanced profile from mass to charge ratio to time of flight and highlights the extent to which portions of the time of flight axis of separation are not used in conventional methods of Time of Flight mass analysis involving enhanced duty cycle. The preferred embodiment seeks to exploit the unused time of flight periods to increase the duty cycle yet further.

Figure 3B:
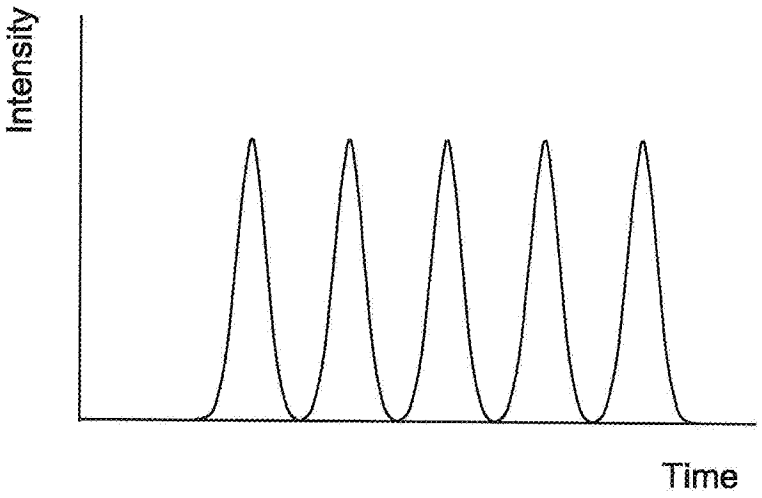
FIG. 3A shows a reduced extraction period with duty cycle enhancement and restricted mass to charge ratio range according to an embodiment of the present invention and FIG. 3B shows a resultant reduced extraction period with duty cycle enhancement and restricted mass to charge ratio range.
Figure 3A:
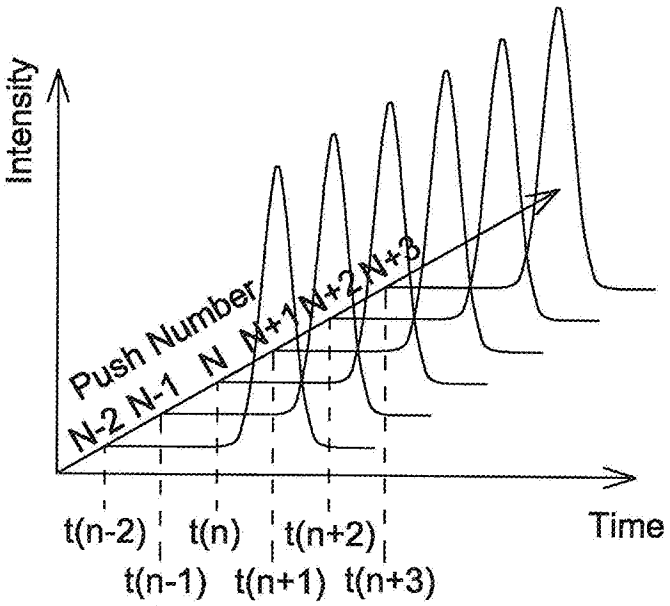

FIGS. 3A and 3B illustrate how a sequence of profiles as shown in FIG. 2B can be arranged according to the preferred embodiment so as to increase the utilisation of the time of flight axis of separation. According to the preferred embodiment the delay between orthogonal acceleration pulses being applied to the orthogonal acceleration region is preferably reduced.

In FIG. 3A the subsequent extraction pulses (pushes) are illustrated along a different axis in order to illustrate how mass spectral overlap is preferably prevented or avoided according to the preferred embodiment but nonetheless better utilisation is made of the time of flight axis as shown in FIG. 3B. As a result, the approach according to the preferred embodiment results in improved duty cycle and dynamic range.

According to a further unillustrated and less preferred embodiment, some useful data may still be obtained if the mass to charge ratio range of interest is smaller than that bounded by the duty cycle enhancement profile. In this case the period between pushes can be reduced still further allowing the tails of adjacent profiles to overlap whilst preventing the tails overlapping the mass to charge ratio range of interest. According to this embodiment although there is some overlap of adjacent profiles along the time axis, the central portion of each profile is preferably not distorted by the tail of an adjacent profile. As a result, the time of flight data in the central portions of each profile can yield some useful data which does not need to be deconvoluted in any manner.

In another embodiment the ions may be arranged to undergo a mass to charge ratio correlated pre-separation prior to the arrival at the orthogonal acceleration region. The ions are preferably separated on a significantly longer time scale than that of the orthogonal acceleration Time of Flight separation.

For example, ions may be separated by Ion Mobility Separation ("IMS"). According to another embodiment ions may be separated using an ion trap in conjunction with a relatively poor resolution mass to charge ratio separator such as a scan-wave device wherein ions are scanned out of an ion trap which has a variable height pseudo-potential barrier located, for example, at the exit of the device.

Figure 4:
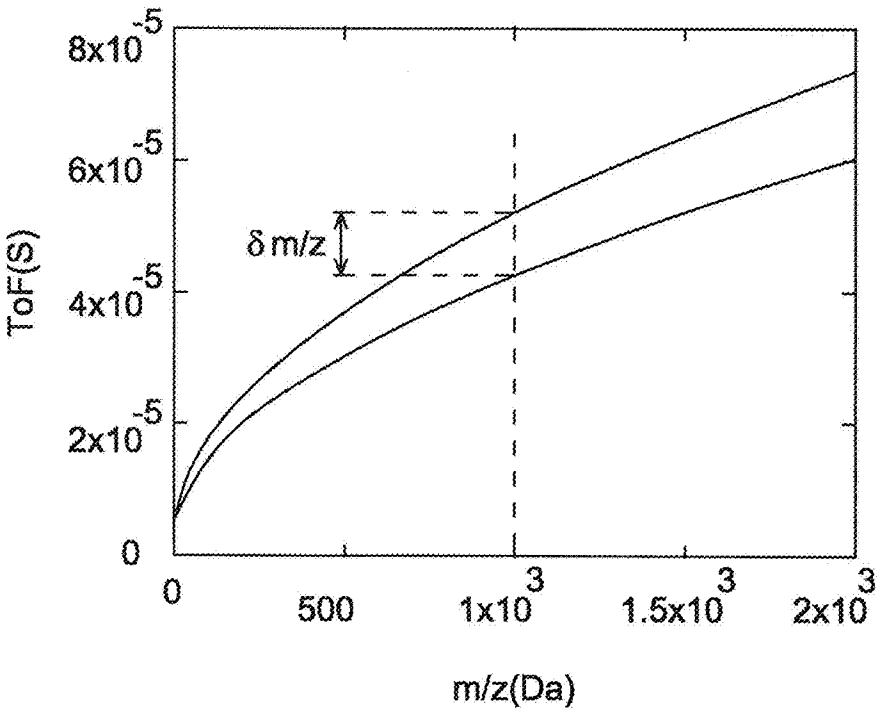
FIG. 4 shows a two dimensional plot showing pre-Time of Flight mass to charge ratio separation.

The longer timescales allow multiple Time of Flight separations per pre-separation cycle resulting in two dimensional data sets as shown in FIG. 4. The x-axis (mass to charge ratio) in FIG. 4 can be considered a function of time or push number. As a result, even given modest resolution pre-separation (ten for FIG. 4), the Time of Flight range at any given push number is significantly restricted as indicated by the δm value for the push number associated with mass to charge ratio of 1000.

In this type of geometry the period between pushes may be increased in synchronisation with the pre-separation on a push to push basis or in more discrete jumps after multiple pushes to again improve the duty cycle and dynamic range as well a sensitivity in this case.

Knowledge of the fast or slow pre-separations and the Time of Flight characteristics preferably allow accurate measurement of the data in real time or post acquisition.

Although the present invention has been described with reference to the preferred embodiments, it will be understood by those skilled in the art that various changes in form and detail may be made without departing from the scope of the invention as set forth in the accompanying claims.

The invention claimed is:

1. A mass spectrometer comprising:

a Time of Flight mass analyser comprising an acceleration electrode, a time of flight region and an ion detector; and a control system arranged and adapted to apply a first extraction pulse to said acceleration electrode in order to accelerate a first group of ions into said time of flight region at a first time T1, wherein ions having the lowest mass to charge ratio in said first group of ions have a time of flight $\Delta T1_{min}$ through said time of flight region and ions having the highest mass to charge ratio in said first group of ions have a time of flight $\Delta T1_{max}$ through said time of flight region;

wherein said control system is arranged and adapted to apply a second extraction pulse to said acceleration electrode at a subsequent second time T2, wherein $\Delta T1_{max}-\Delta T1_{min} \leq T2-T1 < \Delta T1_{max}$;

wherein said mass spectrometer further comprises an acceleration region adjacent said acceleration electrode; and wherein said mass spectrometer further comprises a restriction device arranged upstream of said acceleration region, wherein said restriction device is arranged and adapted to restrict the upper and lower mass to charge ratios and thus the mass to charge ratio range of ions which are present in said acceleration region when an extraction pulse is applied to said acceleration electrode so that the mass to charge ratio range of ions which are subsequently accelerated into said time of flight region is restricted, wherein the restricted mass to charge ratio range of ions entering said Time of Flight mass analyser and arriving at said acceleration region varies over a timescale and wherein the period between extraction pulses is set based upon a predicted variation in the mass to charge ratio range of ions arriving at said acceleration region over said timescale wherein the mass to charge ratio range is deterministically restricted by synchronizing the pulsing of the acceleration with a release of ions from a travelling wave device, wherein the travelling wave device comprises an ion guide comprising a plurality of electrodes wherein one or more transient DC voltages or one or more transient DC voltage waveforms are applied to the electrodes to partition a continuous stream of ions into a series of packets of ions.

2. A mass spectrometer as claimed in claim 1, wherein said control system is arranged and adapted to apply said second extraction pulse to said acceleration electrode in order to accelerate a second group of ions into said time of flight region at said second time T2, wherein ions having the lowest mass to charge ratio in said second group of ions have a time of flight $\Delta T2_{min}$ through said time of flight region and ions having the highest mass to charge ratio in said second group of ions have a time of flight $\Delta T2_{max}$ through said time of flight region, wherein said control system is arranged and adapted to apply a third extraction pulse to said acceleration electrode at a subsequent third time T3, wherein $\Delta T2_{max}-\Delta T2_{min} \leq T3-T2<\Delta T2_{max}$.

3. A mass spectrometer as claimed in claim 2, wherein said control system is arranged and adapted to apply said third extraction pulse to said acceleration electrode in order to accelerate a third group of ions into said time of flight region at said third time T3, wherein ions having the lowest mass to charge ratio in said third group of ions have a time of flight $\Delta T3_{min}$ through said time of flight region and ions having the highest mass to charge ratio in said third group of ions have a time of flight $\Delta T3_{max}$ through said time of flight region, wherein said control system is arranged and adapted to apply a fourth extraction pulse to said acceleration electrode at a subsequent fourth time T4, wherein $\Delta T3_{max}-\Delta T3_{min} \leq T4-T3<\Delta T3_{max}$.

4. A mass spectrometer as claimed in claim 1, wherein said Time of Flight mass analyser comprises an orthogonal acceleration Time of Flight mass analyser.

5. A mass spectrometer as claimed in claim 1, wherein said restriction device is selected from the group consisting of:

(i) a further mass spectrometer or mass analyser;
(ii) an ion trap;
(iii) a Time of Flight mass analyser;
(iv) an ion trap having one or more pseudo-potential barriers wherein ions are scanned out of said ion trap via said one or more pseudo-potential barriers;
(v) a mass filter;
(vi) a quadrupole mass filter;
(vii) a magnetic sector mass filter; and
(viii) an ion mobility separator.

6. A mass spectrometer as claimed in claim 1, wherein said control system is arranged and adapted to determine the mass to charge ratio or time of flight of ions detected by said ion detector based upon knowledge of the restricted mass to charge ratio range of ions which are pulsed into said time of flight region and the characteristics of said Time of Flight mass analyser.

7. A mass spectrometer as claimed in claim 6, where said control system determines the mass to charge ratio or time of flight of ions in real time on an extraction pulse to extraction pulse basis.

8. A mass spectrometer as claimed in claim 6, wherein said control system determines the mass to charge ratio or time of flight of ions by post processing summed or combined data or mass spectral data.

9. A mass spectrometer as claimed in claim 1, wherein the mass to charge ratio range is varied by a device selected from the group consisting of:

(i) a further mass spectrometer or mass analyser;
(ii) an ion trap;
(iii) a Time of Flight mass analyser;
(iv) an ion trap having one or more pseudo-potential barriers wherein ions are scanned out of said ion trap via said one or more pseudo-potential barriers;
(v) a mass filter;
(vi) a quadrupole mass filter;
(vii) a magnetic sector mass filter; and
(viii) an ion mobility separator.

10. A mass spectrometer as claimed in claim 1, wherein the intensity of ions as a function of mass to charge ratio is determined directly by said ion detector without requiring spectral deconvolution or a comparison of two mass spectral data sets.

11. A mass spectrometer as claimed in claim 1, wherein ions are separated in a mass to charge ratio or mass to charge ratio correlated manner prior to arrival at the acceleration region.

12. A mass spectrometer as claimed in claim 11, wherein ions are separated in a mass to charge ratio or mass to charge ratio correlated manner by said restriction device.

13. A method of mass spectrometry comprising:

providing a Time of Flight mass analyser comprising an acceleration electrode, a time of flight region and an ion detector; and applying a first extraction pulse to said acceleration electrode in order to accelerate a first group of ions into said time of flight region at a first time T1, wherein ions having the lowest mass to charge ratio in said first group of ions have a time of flight $\Delta T1_{min}$ through said time of flight region and ions having the highest mass to charge ratio in said first group of ions have a time of flight $\Delta T1_{max}$ through said time of flight region;

applying a second extraction pulse to said acceleration electrode at a subsequent second time T2, wherein $\Delta T1_{max}-\Delta T1_{min} \leq T2-T1<\Delta T1_{max}$;

providing an acceleration region adjacent said acceleration electrode; and arranging a restriction device upstream of said acceleration region, wherein said restriction device is arranged and adapted to restrict the upper and lower mass to charge ratios and thus the mass to charge ratio range of ions which are present in said acceleration region when an extraction pulse is applied to said acceleration electrode so that the mass to charge ratio range of ions which are subsequently accelerated into said time of flight region is restricted, wherein the restricted mass to charge ratio range of ions entering said Time of Flight mass analyser and arriving at said acceleration region varies over a timescale and wherein the period between extraction pulses is set based upon a predicted variation in the mass to charge ratio range of ions arriving at said acceleration region over said timescale wherein the mass to charge ratio range is deterministically restricted by synchronizing the pulsing of the acceleration with a release of ions from a travelling wave device, wherein the travelling wave device comprises an ion guide comprising a plurality of electrodes wherein one or more transient DC voltages or one or more transient DC voltage waveforms are applied to the electrodes to partition a continuous stream of ions into a series of packets of ions.

14. The method of mass spectrometry of claim 13, wherein the intensity of ions as a function of mass to charge ratio is determined directly by said ion detector without requiring spectral deconvolution or a comparison of two mass spectral data sets.

15. A mass spectrometer comprising:

a Time of Flight mass analyser comprising an acceleration electrode, a time of flight region and an ion detector; and a control system arranged and adapted to apply a first extraction pulse to said acceleration electrode in order to accelerate a first group of ions into said time of flight region at a first time T1, wherein ions having the lowest mass to charge ratio in said first group of ions have a time of flight $\Delta T1_{min}$ through said time of flight region and ions having the highest mass to charge ratio in said first group of ions have a time of flight $\Delta T1_{max}$ through said time of flight region;

wherein said control system is arranged and adapted to apply a second extraction pulse to said acceleration electrode at a subsequent second time T2, wherein $\Delta T1_{max} - \Delta T1_{min} \leq T2 - T1 < \Delta T1_{max}$;

wherein said mass spectrometer further comprises an acceleration region adjacent said acceleration electrode; and wherein the mass to charge ratio range arriving at the acceleration region is restricted by synchronising the pulsing of the acceleration electrode with a release of packets from an upstream travelling wave device, wherein the travelling wave device comprises an ion guide comprising a plurality of electrodes wherein one or more transient DC voltages or one or more transient DC voltage waveforms are applied to the electrodes to partition a continuous stream of ions into a series of packets of ions.

* * * * *